US007913456B2

(12) United States Patent
Balbo Di Vinadio

(10) Patent No.: US 7,913,456 B2
(45) Date of Patent: Mar. 29, 2011

(54) METHOD FOR MOUNTING A CONTROL ASSEMBLY FOR DOORS AND WINDOWS

(75) Inventor: Aimone Balbo Di Vinadio, Chiusa San Michele (IT)

(73) Assignee: Savio S.p.A., Turin (IT)

( * ) Notice: Subject to any disclaimer, the term of this patent is extended or adjusted under 35 U.S.C. 154(b) by 358 days.

(21) Appl. No.: 12/167,503

(22) Filed: Jul. 3, 2008

(65) Prior Publication Data

US 2009/0025301 A1 Jan. 29, 2009

(30) Foreign Application Priority Data

Jul. 23, 2007 (EP) ..... 07425450

(51) Int. Cl.
*E06B 3/00* (2006.01)

(52) U.S. Cl. ..... 49/506; 49/460; 29/270; 29/700

(58) Field of Classification Search ..... 49/192, 49/193, 460, 503, 506; 29/244, 270, 700
See application file for complete search history.

(56) References Cited

U.S. PATENT DOCUMENTS

| | | | | |
|---|---|---|---|---|
| 3,408,100 | A * | 10/1968 | McKey | 292/216 |
| 6,782,661 | B2 * | 8/2004 | Manzella | 49/192 |
| 7,644,538 | B2 * | 1/2010 | Balbo Di Vinadio | 49/192 |
| 7,752,809 | B2 * | 7/2010 | Di Vinadio | 49/192 |
| 2008/0016773 | A1 * | 1/2008 | Di Vinadio | 49/192 |
| 2008/0016774 | A1 * | 1/2008 | Vinadio | 49/192 |
| 2008/0016782 | A1 * | 1/2008 | Balbo Di Vinadio | 49/506 |

FOREIGN PATENT DOCUMENTS

| | | | |
|---|---|---|---|
| GB | 2067638 A | * | 7/1981 |
| GB | 2147657 A | * | 5/1985 |

* cited by examiner

*Primary Examiner* — Jerry Redman
(74) *Attorney, Agent, or Firm* — Patterson & Sheridan, L.L.P.

(57) ABSTRACT

Method for mounting a control assembly for doors or windows, in which the door or window comprises a frame including a metallic section bar having an outer wall and a longitudinal groove, and in which the control assembly comprises a handle having a base, a rotatable grip and a rotatable control pin, a transmission device having an input member able to be coupled with the control pin of the handle and at least one carriage movable in rectilinear direction, and connected to the input member by means of a mechanism, a rod able to slidably engage said groove, and a connecting member able to be fastened to the rod. The method comprises the steps of positioning said rod in said groove with said connecting member positioned slidably on the rod, applying the transmission mechanism to the section bar, mutually connecting said carriage and said connecting member so that the connecting member is fixed to said carriage for movements in the longitudinal direction of the groove, and after mutually connecting said carriage and the connecting member, fastening the connecting member to the rod.

4 Claims, 21 Drawing Sheets

METHOD FOR MOUNTING A CONTROL ASSEMBLY FOR DOORS AND WINDOWS

CROSS-REFERENCE TO RELATED APPLICATIONS

This application claims benefit of European patent application number 07425450.9, filed Jul. 23, 2007, which is herein incorporated by reference.

BACKGROUND OF THE INVENTION

1. Field of the Invention

The present invention relates to a method for mounting a control assembly for doors and windows. More specifically, the invention relates to a method for mounting a control assembly comprising a control handle, a transmission device having a rotating input member and an output member that is movable in rectilinear direction, and a rod mounted slidably in a groove of a metallic section bar comprised in the frame of the door or window.

2. Description of the Related Art

In traditional solutions, mounting such control assemblies requires cutting the transmission rods to measure and forming, on the rods, holes for coupling with the transmission device.

Cutting the rods to measure and forming the coupling holes entails the possibility of errors and introduce mounting play which could compromise the correct operation of the mechanism associated with the control assembly.

SUMMARY OF THE INVENTION

The object of the present invention is to provide an improved solution for mounting a control assembly for doors or windows of the type defined above, which enables to simplify the mounting operations and, at the same time, to improve mounting precision.

According to the present invention, the object is achieved by a method for mounting a control assembly for doors or windows, in which the door or window comprises a frame including a metallic section bar having an outer wall and a longitudinal groove with an undercut section and an open edge contained in a plane that is orthogonal to the outer face. The control assembly comprises a handle having a base, a rotatable grip and a rotatable control pin rotatably connected to the grip. The control assembly further comprises a transmission device having an input member able to be coupled with the control pin of the handle and at least one carriage movable in a rectilinear direction and connected to the input member by a mechanism able to transform the rotary motion of the input member into a rectilinear motion of the carriage. Additionally, the control assembly comprises a rod able to slidably engage the groove and a connecting member able to be fastened to the rod. The method includes the step of positioning the rod in the groove with the connecting member positioned slidably on the rod. The method also includes the step of applying the transmission device to the section bar. The method further includes the step of mutually connecting the carriage and the connecting member so that the connecting member is fixed to the carriage in a longitudinal direction of the groove. In addition, the method includes the step of fastening the connecting member to the rod after mutually connecting the carriage and the connecting member.

As shall become readily apparent in the remainder of the description, the method according to the present invention provides for the use of a single rod associated with the transmission device and does not require cutting the rod to measure or the prior formation of coupling holes.

BRIEF DESCRIPTION OF THE DRAWINGS

The present invention shall now be described in detail with reference to the accompanying drawings, provided purely by way of non limiting example, in which.

DETAILED DESCRIPTION

Figure 1:
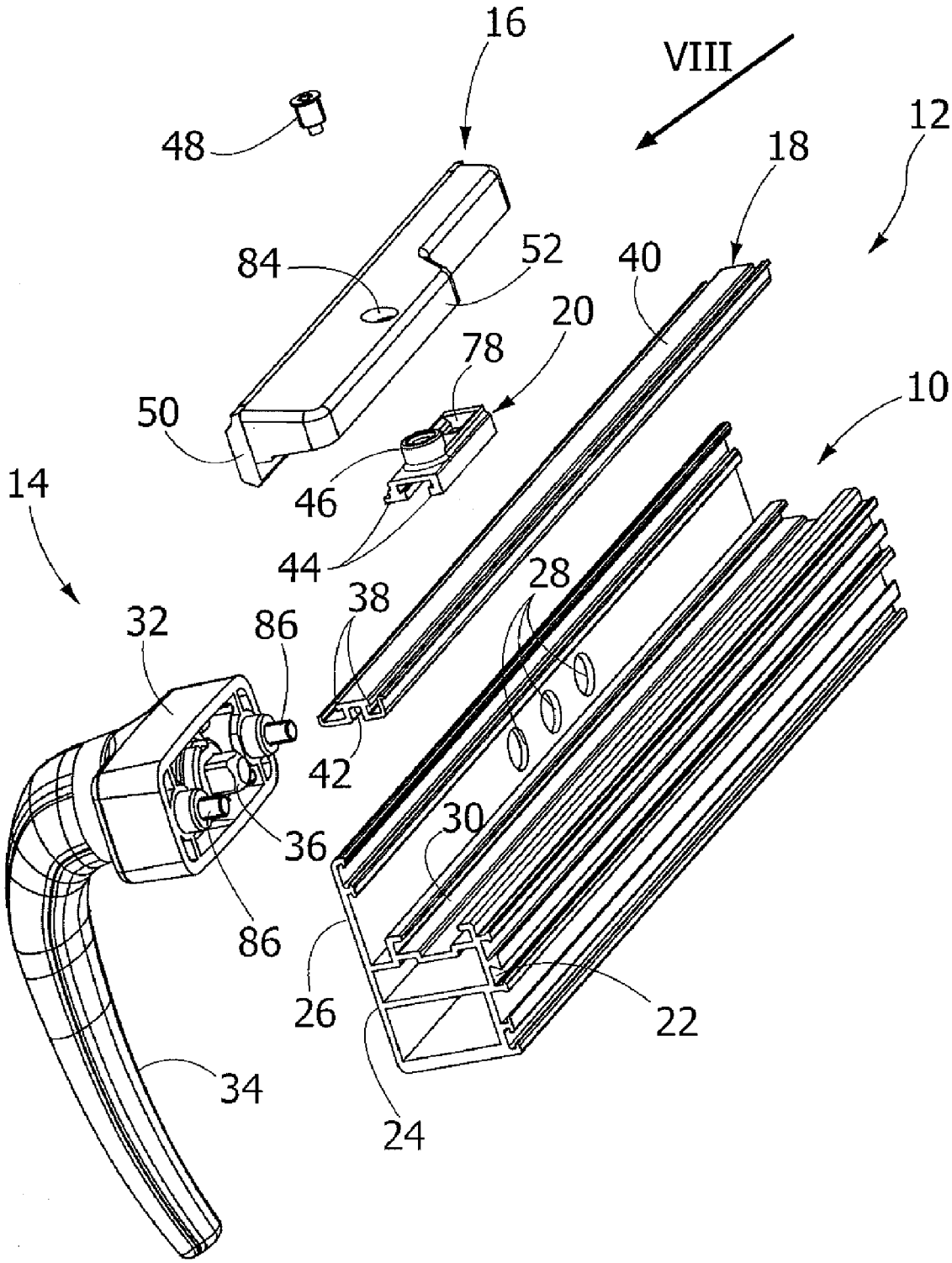
FIGS. 1 through 5 are perspective views showing the mounting sequence of a control assembly for windows or doors according to a first embodiment of the present invention.

With reference to FIG. 1, the number 10 designates a segment of a metallic section bar comprised in a movable frame of a door or window.

The number 12 designates a control assembly for controlling the opening and the closing of the door or window, that is to be mounted on the section bar 10 in the manner described below. The control assembly 12 comprises a handle 14, a transmission device 16, a rod 18 and a connecting member 20.

The section bar 10 is constituted by metallic material, e.g. aluminium or alloys thereof, and it is obtained by extrusion, profiling or the like. In cross section, the section bar 10 has a closed box portion 22 having an outer wall 24 provided with an integral wing 26 which projects in overhand from the closed box portion 22. In the wing 26 are formed three through holes 28 whose function shall become readily apparent hereafter. The section bar 10 further comprises a groove 30 with undercut cross section, which extends in a longitudinal direction. The groove 30 has an open edge contained in an orthogonal plane relative to the wing 26.

The handle 14 comprises a base 32 and a rotatable grip 34. The base 32 carries a control pin 36 with square section rotatably connected to the grip 34 and projecting from the base 32 from the opposite side relative to the grip 34.

The rod 18 is so shaped as to couple slidably within the groove 30. The rod 18 is preferably formed as described in detail in European patent application 06 425 583 by the same applicant. In particular, the rod 18 comprises two parallel lateral grooves 38 separated from each other by a continuous central portion having a longitudinal wall 40. Underneath the longitudinal wall 40 is formed a central longitudinal groove 42 open in opposite direction relative to the two lateral grooves 38.

The connecting member 20 is provided with coupling portions 44 that slidably engage the lateral grooves 38 of the rod 18. The connecting member 20 comprises a threaded portion 46 that is engaged by a screw 48 that is destined to fasten the connecting member 20 to the rod 18 in a selected relative position. As is described in detail in the European patent application 06 425 583 mentioned previously, the screw 48 of the connecting member 20 forms a through hole in the longitudinal wall 40 of the rod 18 when the screw 48 is fully tightened in the threaded portion 46 of the connecting member 20. The tip of the screw 48 shears a corresponding portion of the wall 40, forming a through hole which is used for the definitive fastening between the connecting body 20 and the rod 18 in the selected relative position. The connecting member 20 is also provided with a seat 78 whose function shall be readily apparent hereafter.

Figure 8:
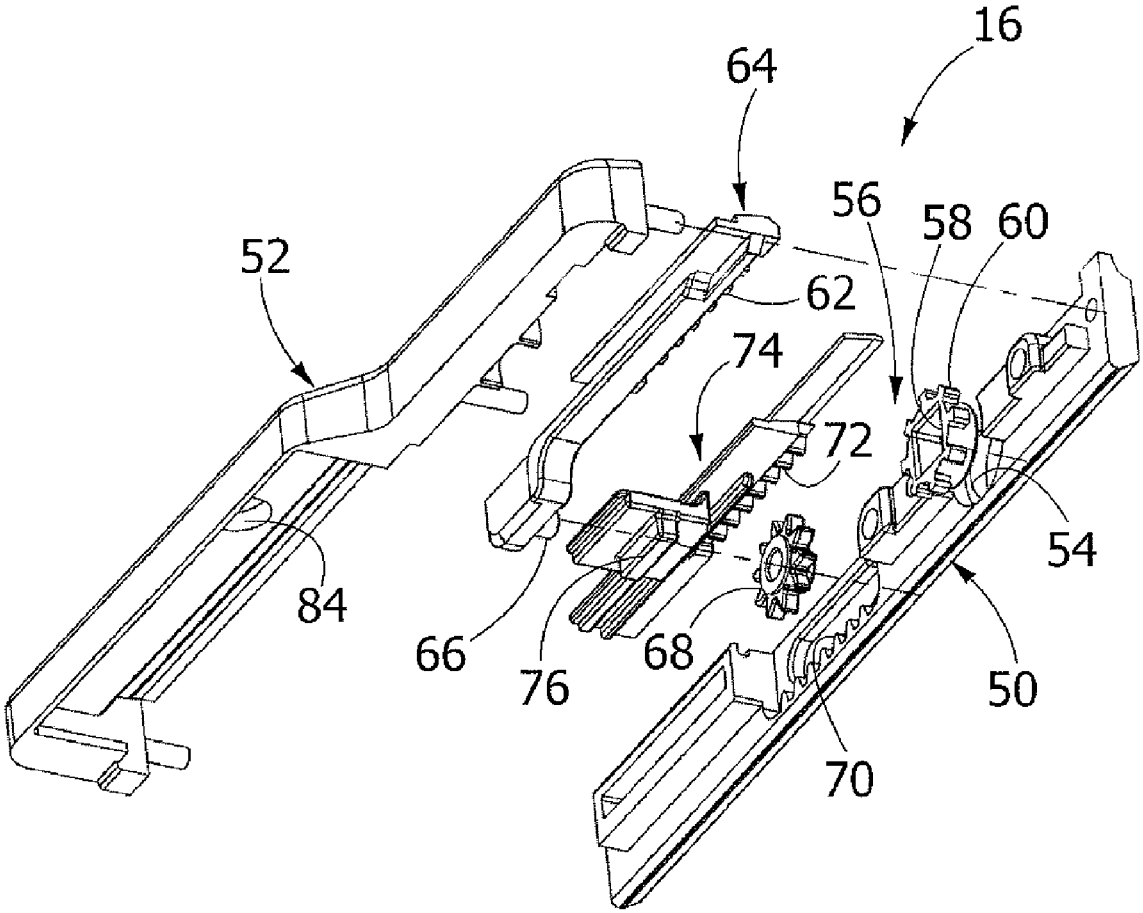
FIG. 8 is an exploded perspective view of the transmission device indicated by the arrow VIII in FIG. 1.

The transmission device 16 transforms the rotary movement of the control pin 36 of the handle 14 into a rectilinear motion of the rod 18 in the direction of the groove 30. With reference to FIG. 8, the transmission device 16 comprises a casing formed by two metallic bodies 50, 52 fastened to each other. The first body 50 has a hole 54 whereat is rotatably mounted an input member 56 having a square hole 58 which couples with the control pin 36 of the handle 14. The input member 56 has a toothing 60 that meshes with a first rack 62 formed on a first carriage 64. The first carriage 64 has a pivot 66 whereon is slidably mounted a gear wheel 68 with axis of rotation parallel to the axis of rotation of the input member 56. The gear wheel 68 simultaneously meshes with a second rack 70 formed on the first body 50 and with a third rack 72 formed on a second carriage 74. The second carriage 74 has an integral output member 76 formed by a protuberance which is destined to engage the complementary seat 78 (FIG. 1) formed in the connecting member 20.

Figure 9:
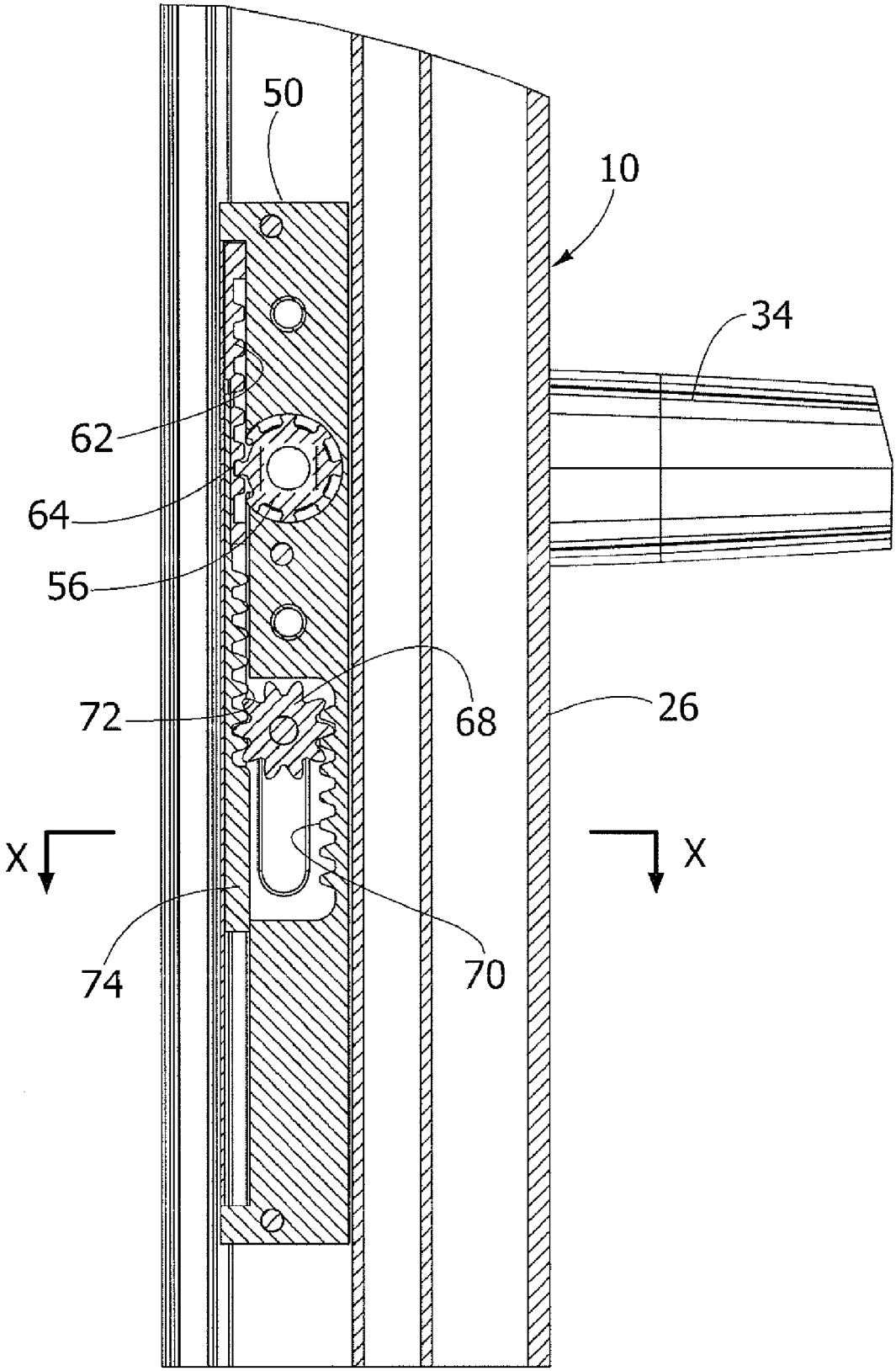
FIG. 9 is a section according to the line IX-IX of FIG. 5.
Figure 10:
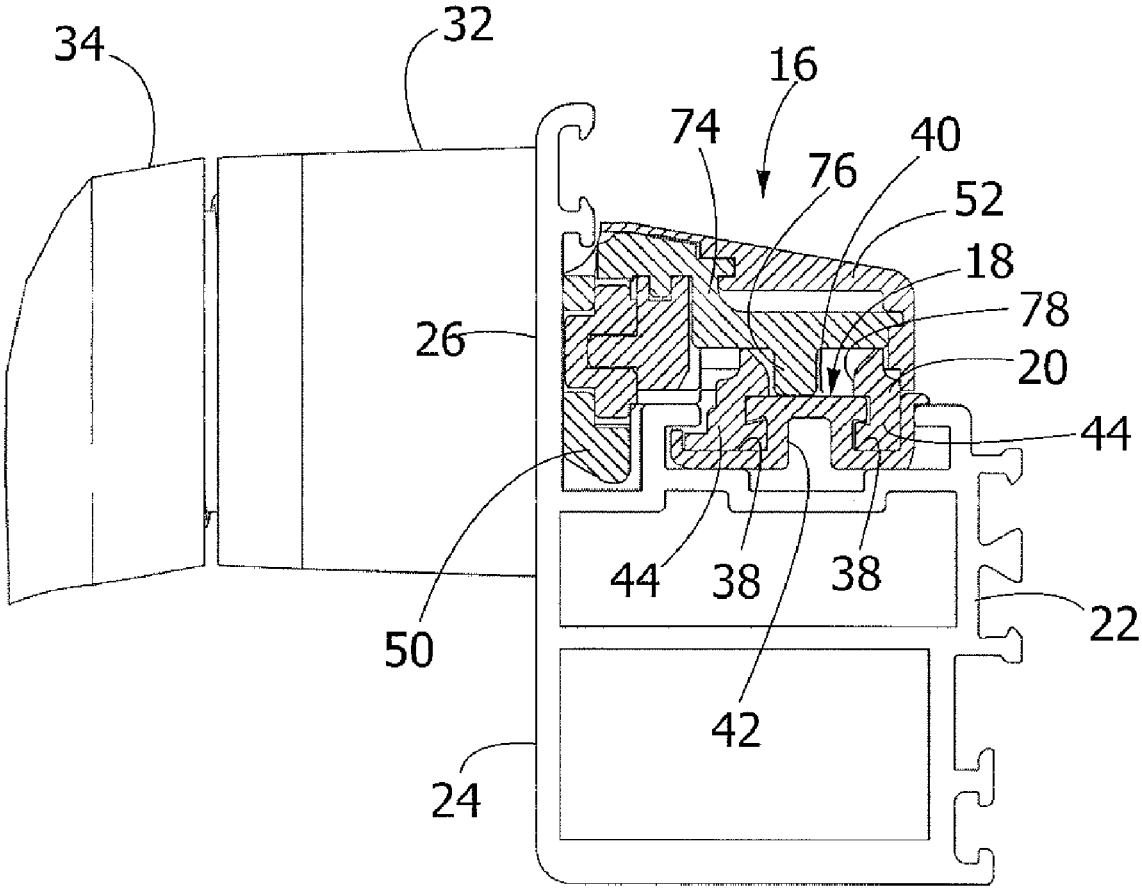
FIG. 10 is a section according to the line X-X of FIG. 9.

The described mechanism enables to multiply the work travel of the second carriage 74 relative to that of the first carriage 64. With reference to FIG. 9, the rotation movement of the input member 56 causes, thanks to the meshing with the first rack 62, a movement of the first carriage 6 in rectilinear direction 4. The gear wheel 68 moves in rectilinear direction together with the first carriage 64. By effect of the meshing of the gear wheel 68 with the fixed rack 70 and with the rack 72 integral with the second carriage 74, a multiplication of the rectilinear travel of the second carriage 74 is obtained.

The method for mounting the control assembly 12 on the section bar 10 shall now be described with reference to the FIGS. 2 through 7.

Figure 2:
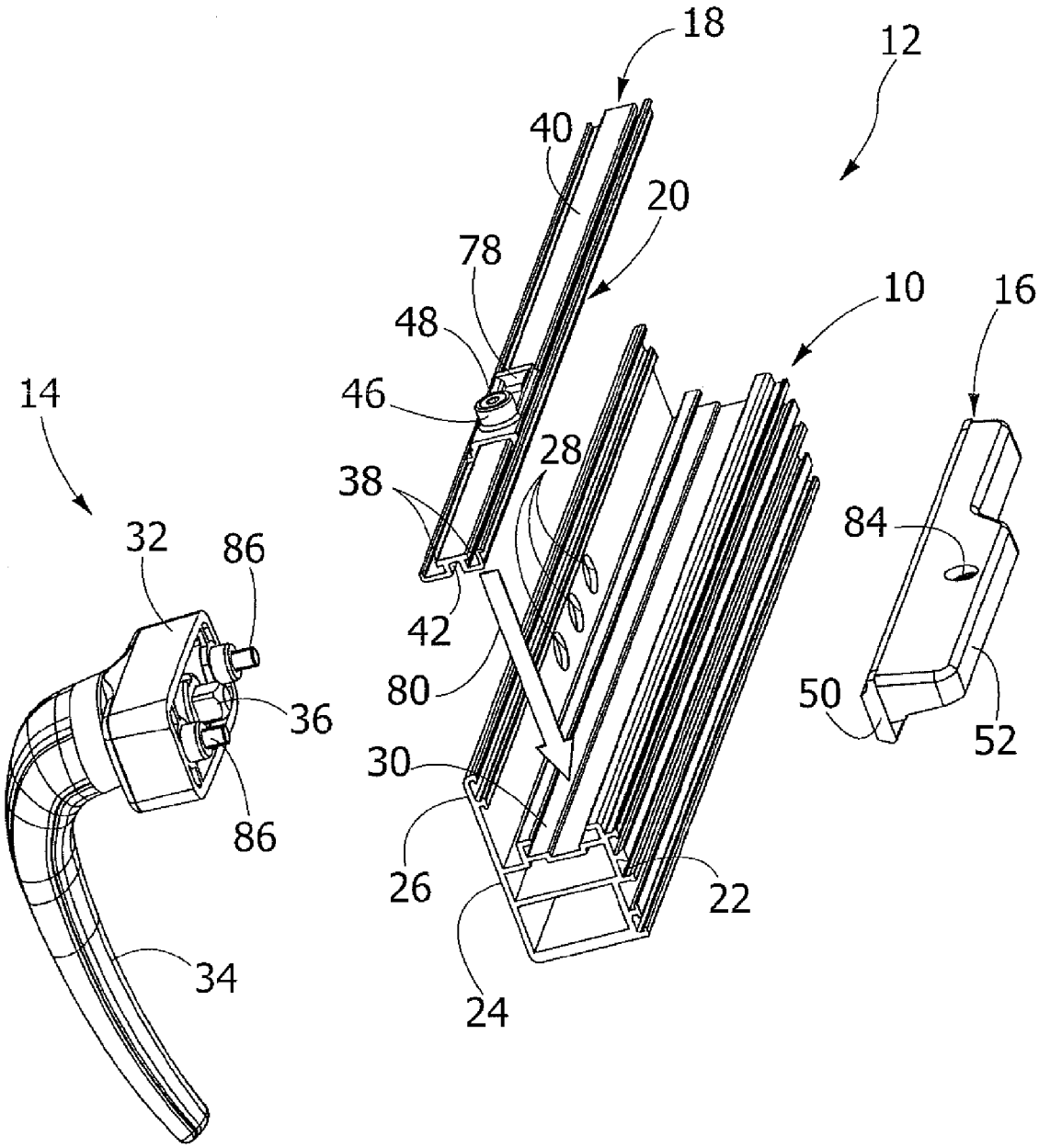

With reference to FIG. 2, in a first step the connecting member 20 is applied in slidable manner on the rod 18. In this step, the connecting member 20 is not definitively fastened to the rod 18 and is free to slide relative to the rod 18 in longitudinal direction. The rod 18 with the connecting member 20 is inserted into the groove 30 of the section bar 10 in the direction indicated in the arrow 80 in FIG. 2.

Figure 3:
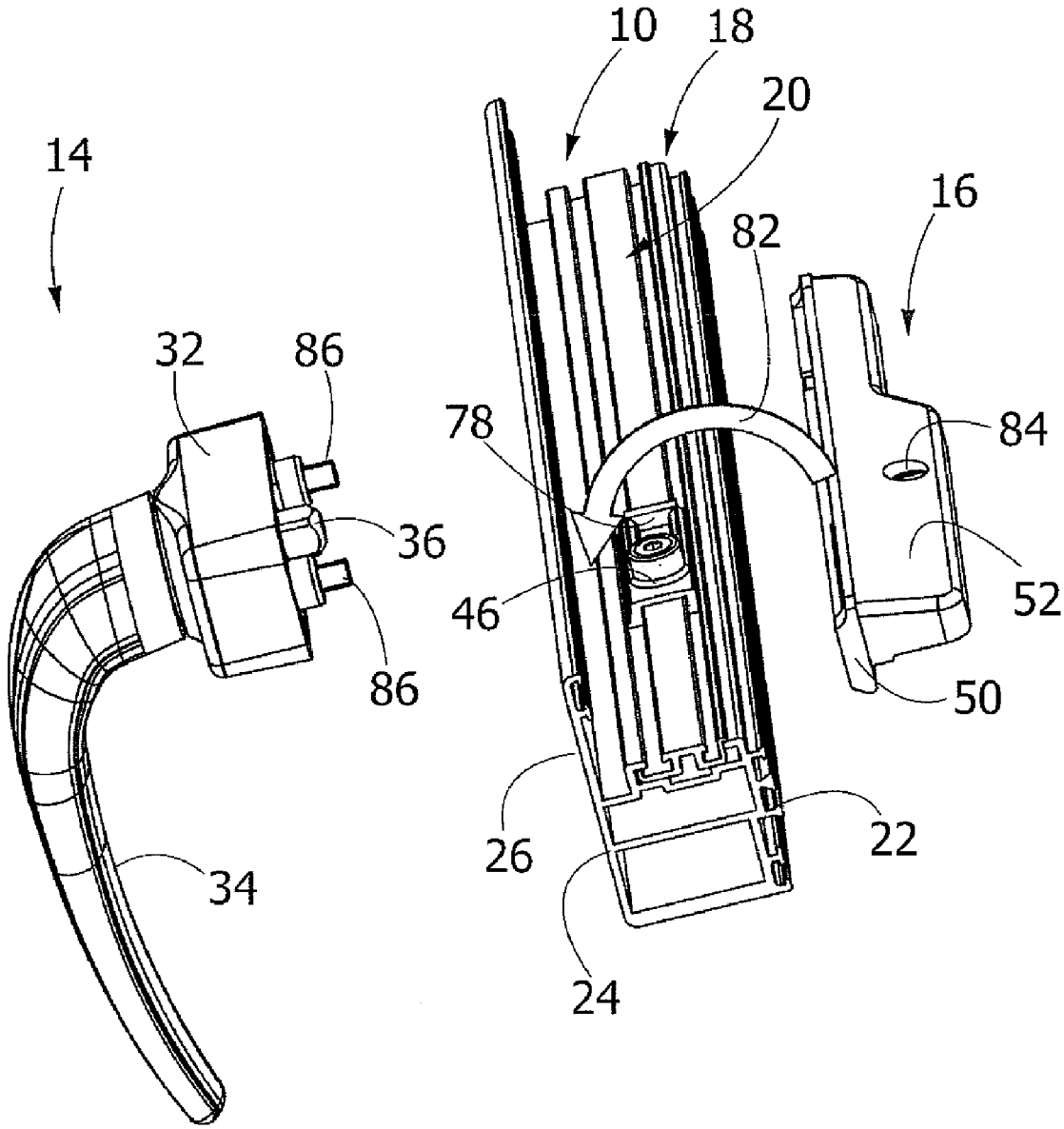

In the subsequent step, the transmission device 16 is applied on the inner face of the wing 26 in the direction indicated by the arrow 82 in FIG. 3. The transmission device 16 is positioned in such a way that the output member 76 (FIG. 8) of the transmission device 16 is inserted into the corresponding seat 78 of the connecting member 20. The second body 52 of the transmission device 16 has a through hole 84 which is positioned at the threaded portion 46 of the connecting member 20. The hole 54 (FIG. 8) of the transmission device 16 is positioned at the central hole 28 of the wing 26.

Figure 4:
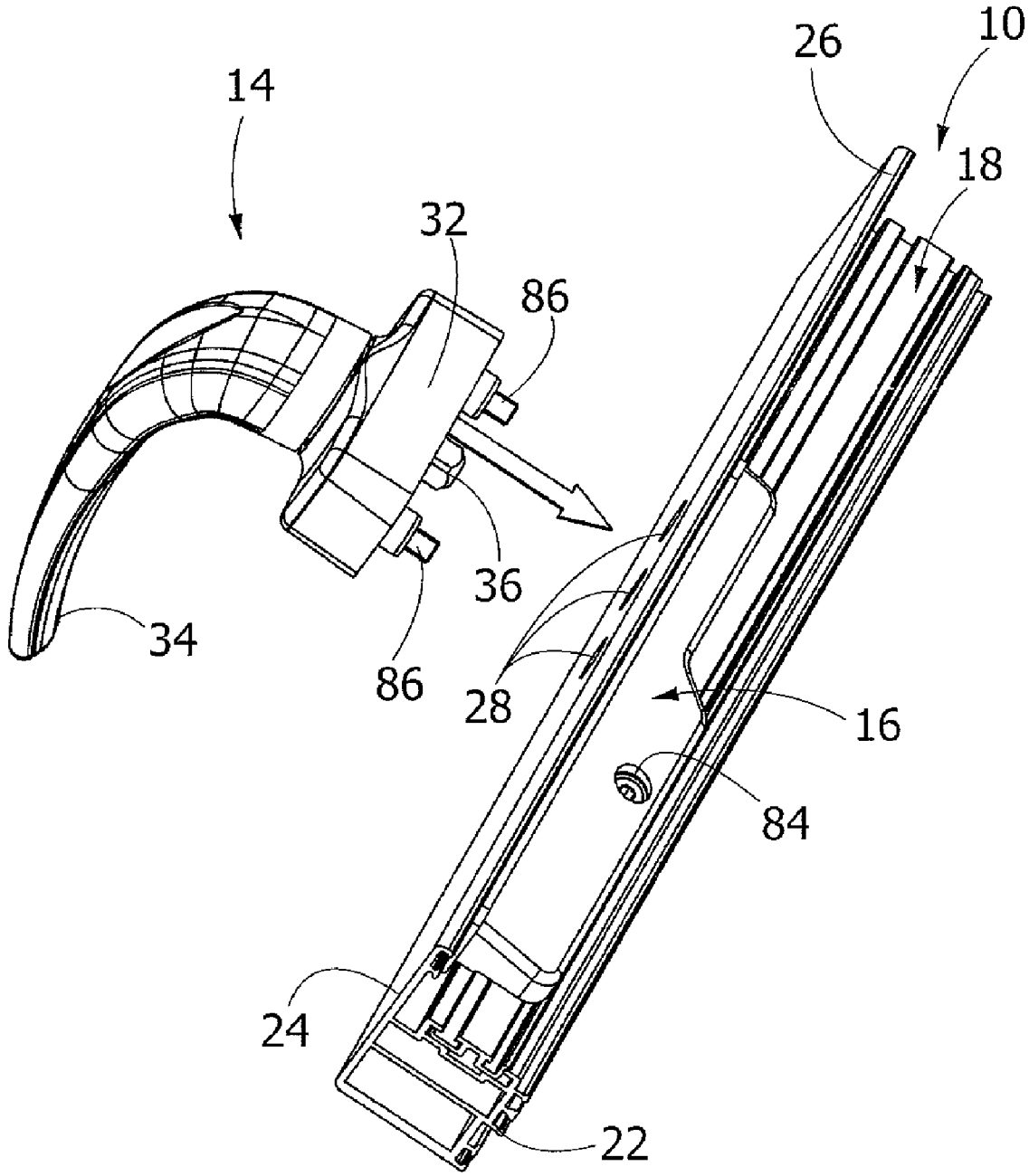

Subsequently, as shown in FIG. 4, the handle 14 is applied on the outer side of the wing 26. The control pin 36 is inserted into the central hole 28 and is coupled with the input member 56 of the transmission device 16. The base 32 of the handle 14 is provided with holes for two fastening screws 86 which are inserted into the two lateral holes 28 of the wing 26. The screws 86 engage respective threaded holes formed in the first body 50 of the transmission device 16. The handle 14 is fastened to the transmission device 16 and to the section bar 10 by screwing the screws 86.

Figure 5:
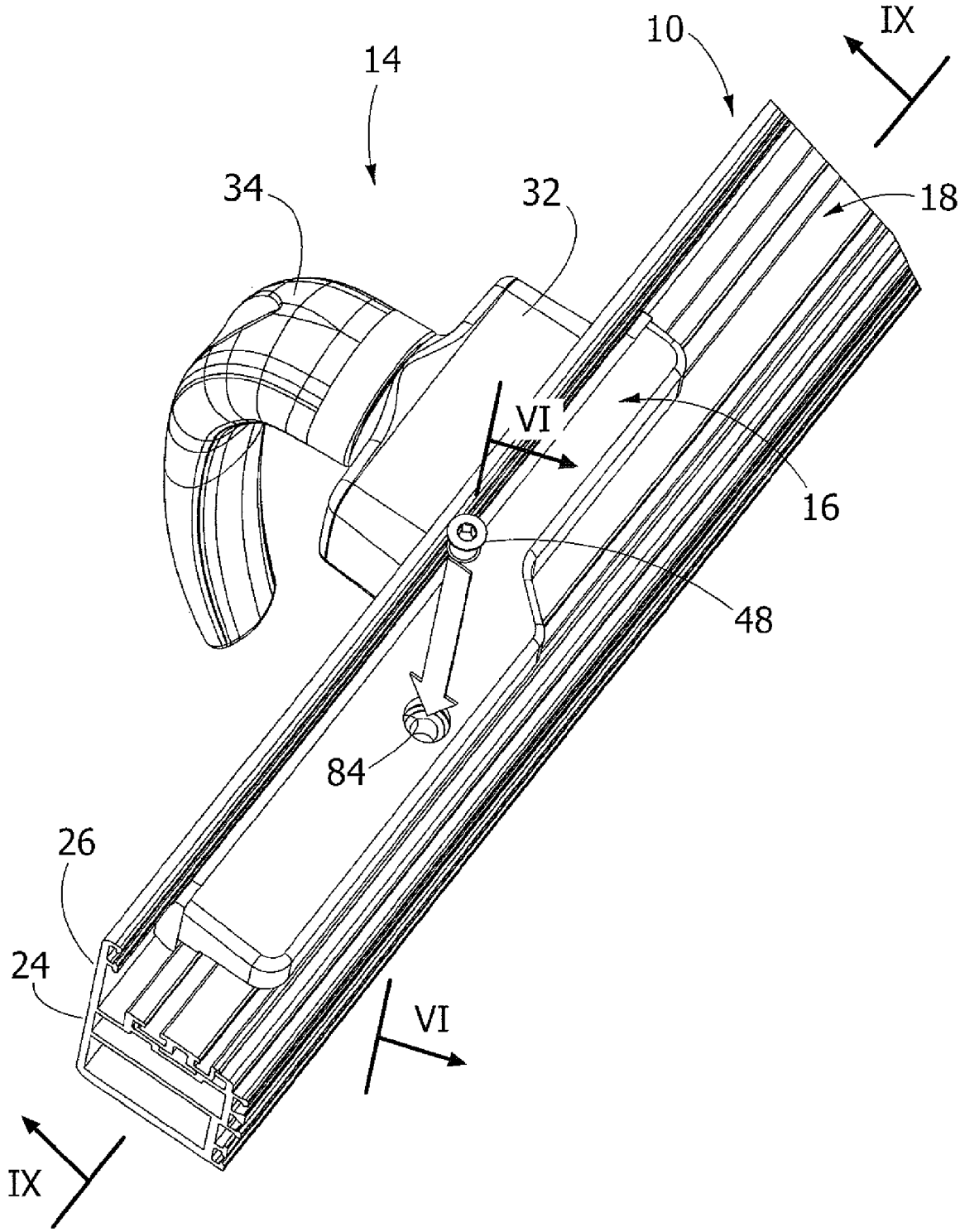
Figure 6:
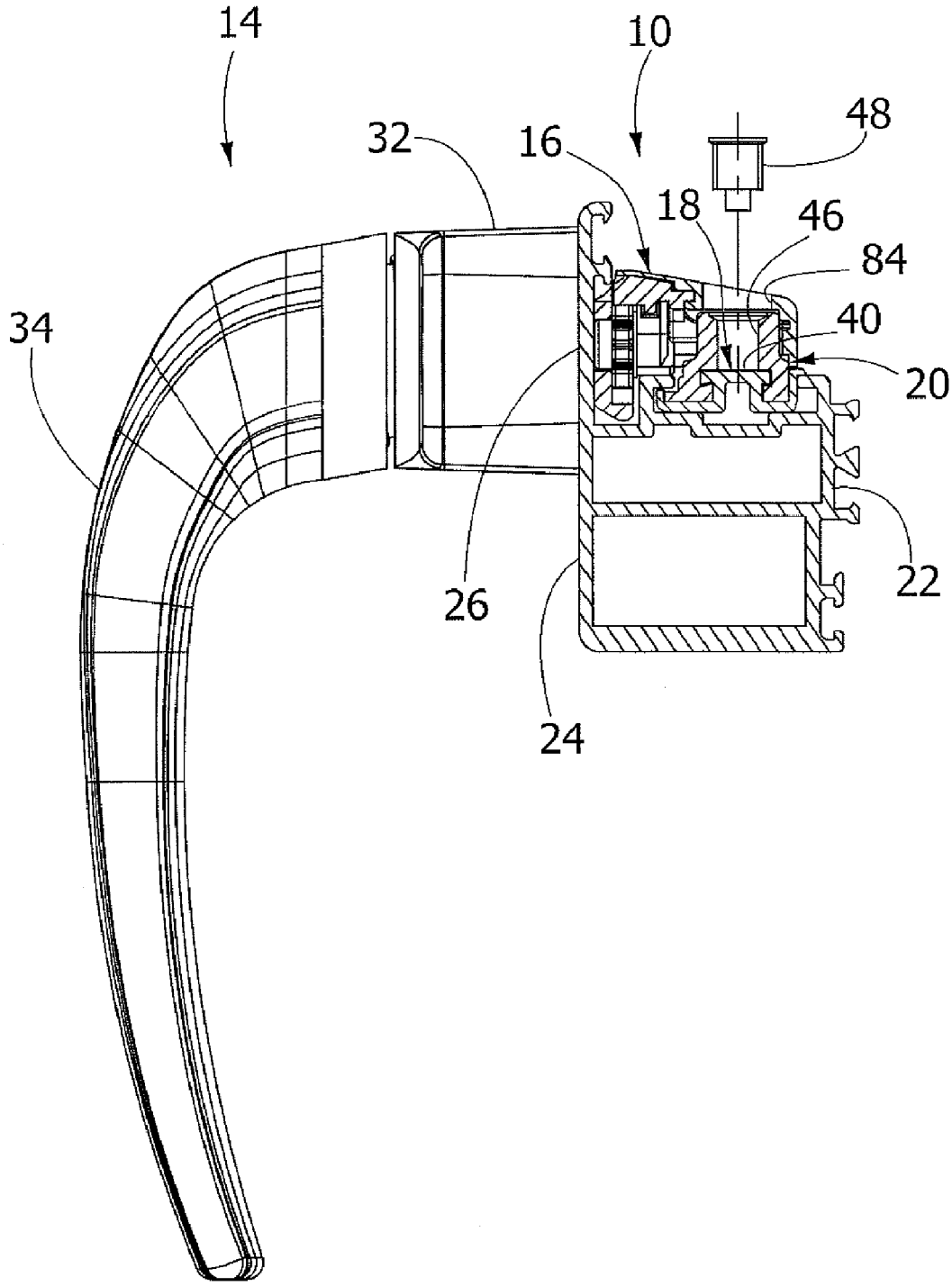
FIGS. 6 and 7 are sections according to the line VI-VI of FIG. 5.
Figure 7:
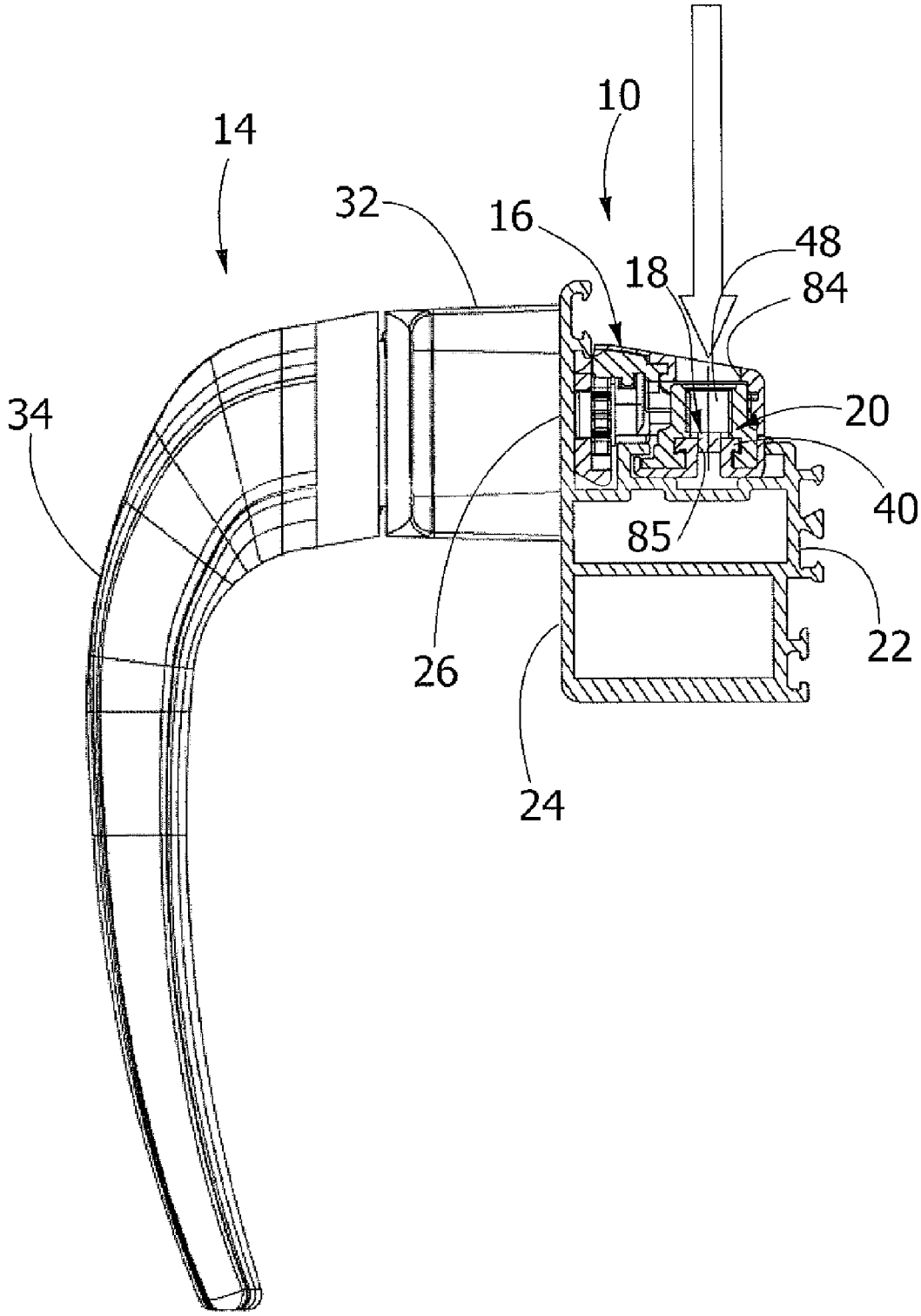

At this point, the connecting member 20 is integral with the second carriage 74 of the transmission device 16 for movements in longitudinal direction thanks to the engagement between the output member 76 and the complementary seat 78. The rod 18 and the connecting member 20 are, however, free to move relative to one another in longitudinal direction. In this condition, the connecting member 20 is fastened to the rod 18. Said fastening is carried out by completely tightening the screw 48 that engages the threaded portion 46 of the connecting member 20. Screw 48 is tightened by acting with a spanner (not shown) through the through hole 84 of the transmission member 16, as shown in FIGS. 5, 6 and 7. As described in detail in the aforementioned European patent application no. 06 425 583, when the screw 48 is tightened completely, a through hole 85 is formed in the longitudinal wall 40 of the rod 18, as shown in FIG. 7. At this point, the mounting of the control assembly 12 is complete.

A particularly advantageous characteristic of the present invention is that a single rod 18 is provided, associated with the transmission device 16. Mounting the control assembly 12 does not require cutting the rod 18 to measure or forming fastening holes on the rod before the mounting operation. The hole for fastening the rod 18 to the connecting body 20 is formed by completely tightening the screw 48 after the rod has been placed in the desired position with respect to the connecting member 20 and to the transmission device 16. The method according to the present invention therefore enables to eliminate play and mounting inaccuracies because the definitive fastening of the rod to the connecting member is performed after the rod is positioned in the correct manner.

Figure 11:
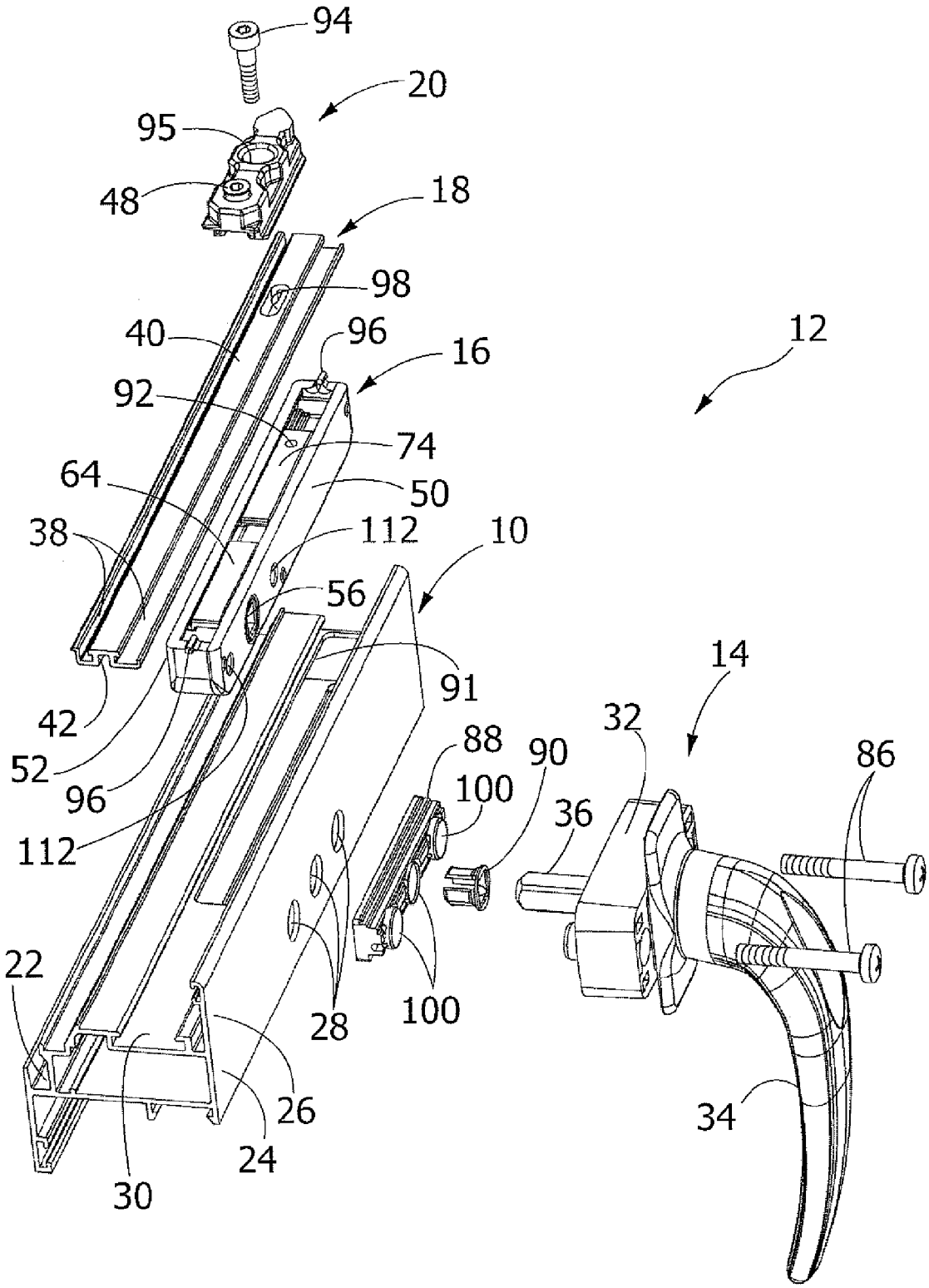
FIG. 11 is an exploded perspective view showing a second embodiment of a control device according to the present invention.

FIG. 11 shows a second embodiment of a control assembly 12. Details corresponding to those described previously are indicated with the same numerical references.

As in the embodiment described above, the control assembly 12 comprises a handle 14, a transmission device 16, a rod 18 and a connecting member 20. The control assembly 12 of this second embodiment further comprises a spacer element 88 and a bushing 90.

In this second embodiment, the transmission device 16 is housed within the box body 22 of the section bar 10. Therefore, in the bottom wall of the groove 30 is obtained an opening 91 which enables to insert the transmission device 16 into the box portion 22. The three holes 28 are formed in the outer wall 24 of the section bar 10 at the box portion 22.

The transmission device 16 has a different shape relative to that of the previous described device, but it functions in identical fashion. As in the embodiment described above, the transmission device 16 comprises an enclosure formed by two bodies 50, 52, an input member 56 provided with a square hole, a first carriage 64 and a second carriage 74. In this case as well, the first and the second carriage 64, 74 are associated to a rack transmission mechanism which multiplies the translation travel of the second carriage 74. The second carriage 74 is provided with a threaded hole 92 which is engaged by a screw 94 that extends through a through hole 95 of the connecting member 20. The screw 94 serves the same function as the output member 76 of the transmission device described previously. The enclosure of the transmission device 16 is provided with two appendages 96 which bear on the opposite shorter sides of the opening 91 to support the transmission device 16 in the inner cavity of the boxy portion 22.

An additional difference with respect to the embodiment described above is that in this second embodiment it is necessary to form in the rod 18 a through opening 98 elongated in longitudinal direction, whose function shall become readily apparent below.

The method for mounting this second embodiment of the control assembly 12 is shown in FIGS. 12 through 21.

Figure 12:
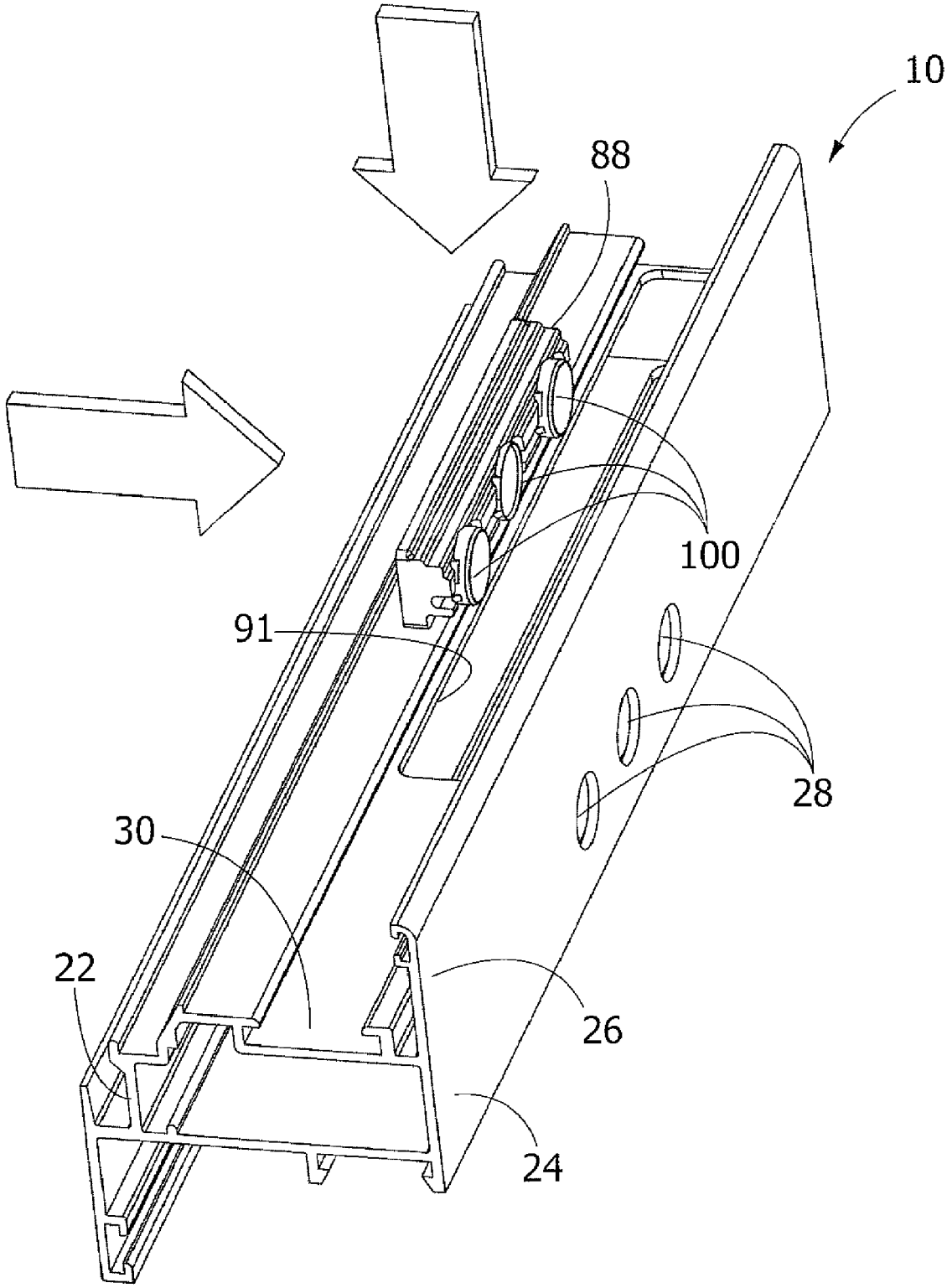
FIGS. 12 to 21 show the mounting sequence of the control device shown in FIG. 11.
Figure 13:
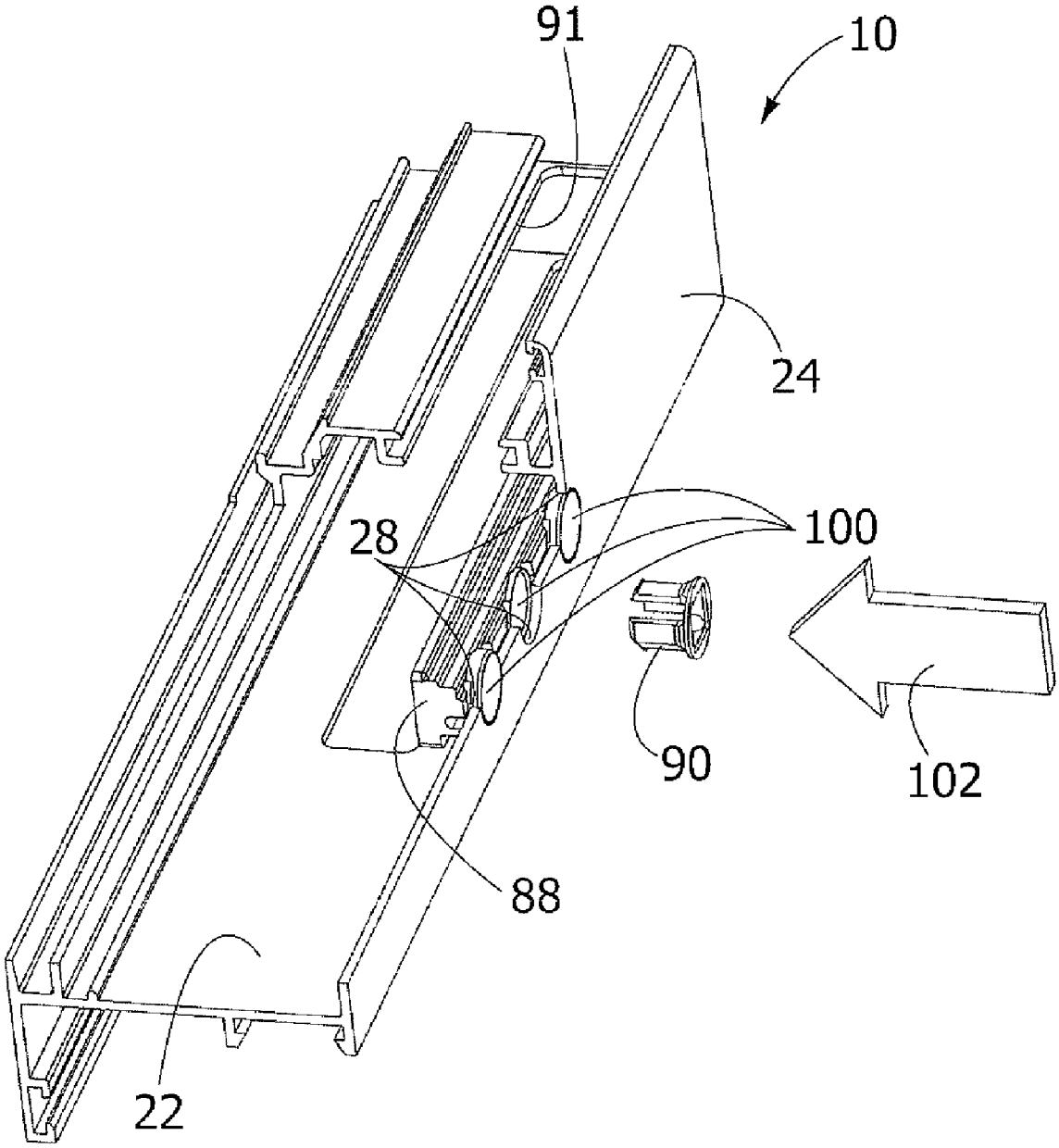

With reference, initially, to FIG. 12, the spacer 88 is inserted through the opening 91 into the cavity of the box portion 22 of the section bar 10. The spacer 88 is provided with three through holes 100 which are positioned at the holes 28 formed in the outer wall 24 of the section bar 10. With reference to FIG. 13, the bushing 90 is inserted in the direction indicated by the arrow 102 in the central hole 28 of the section bar 10 and in the central hole 100 of the spacer 88. The bushing 90 is provided with elastically deformable teeth which engage in snap-in manner the spacer 88, retaining it in position.

Figure 14:
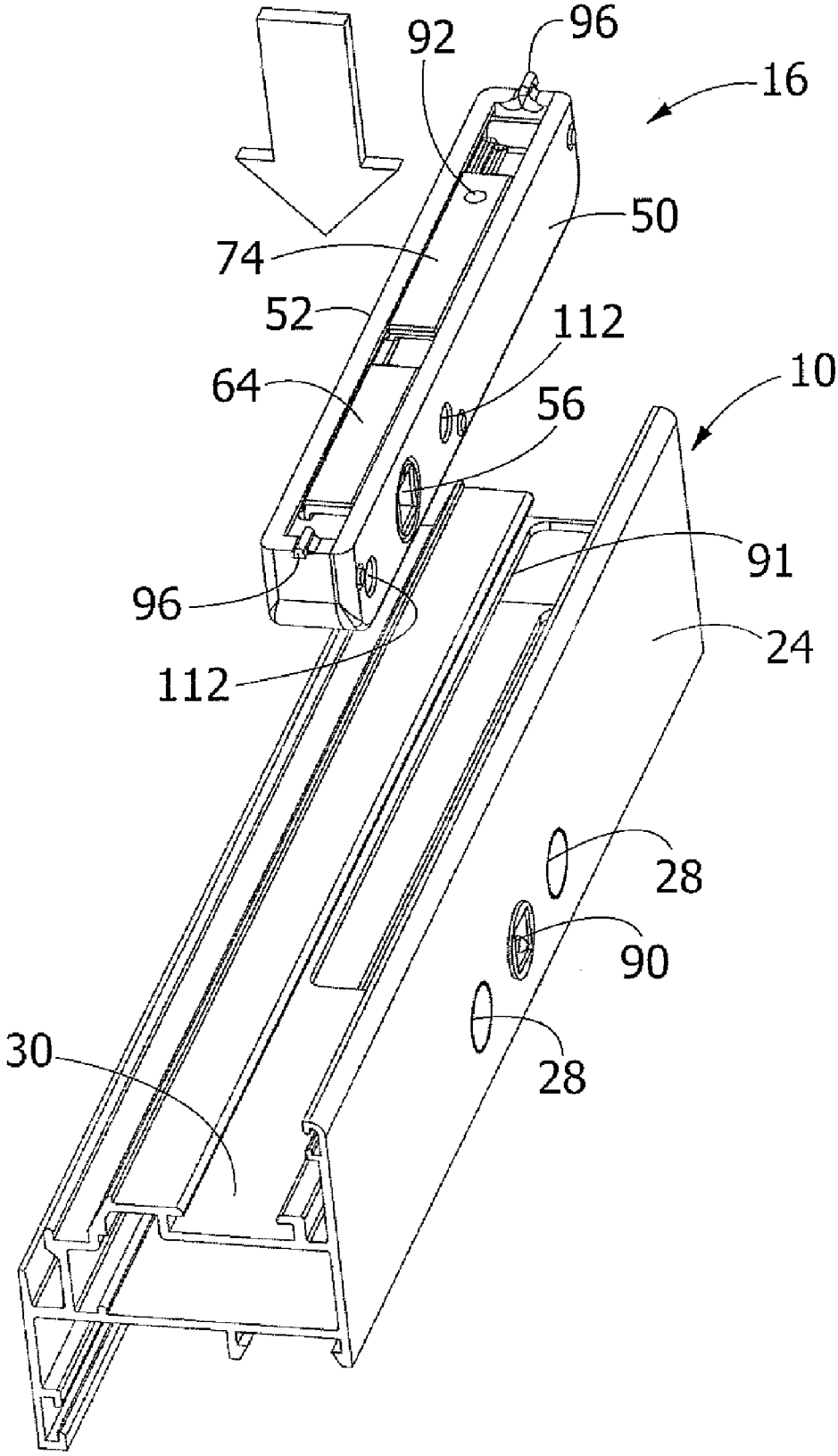
Figure 15:
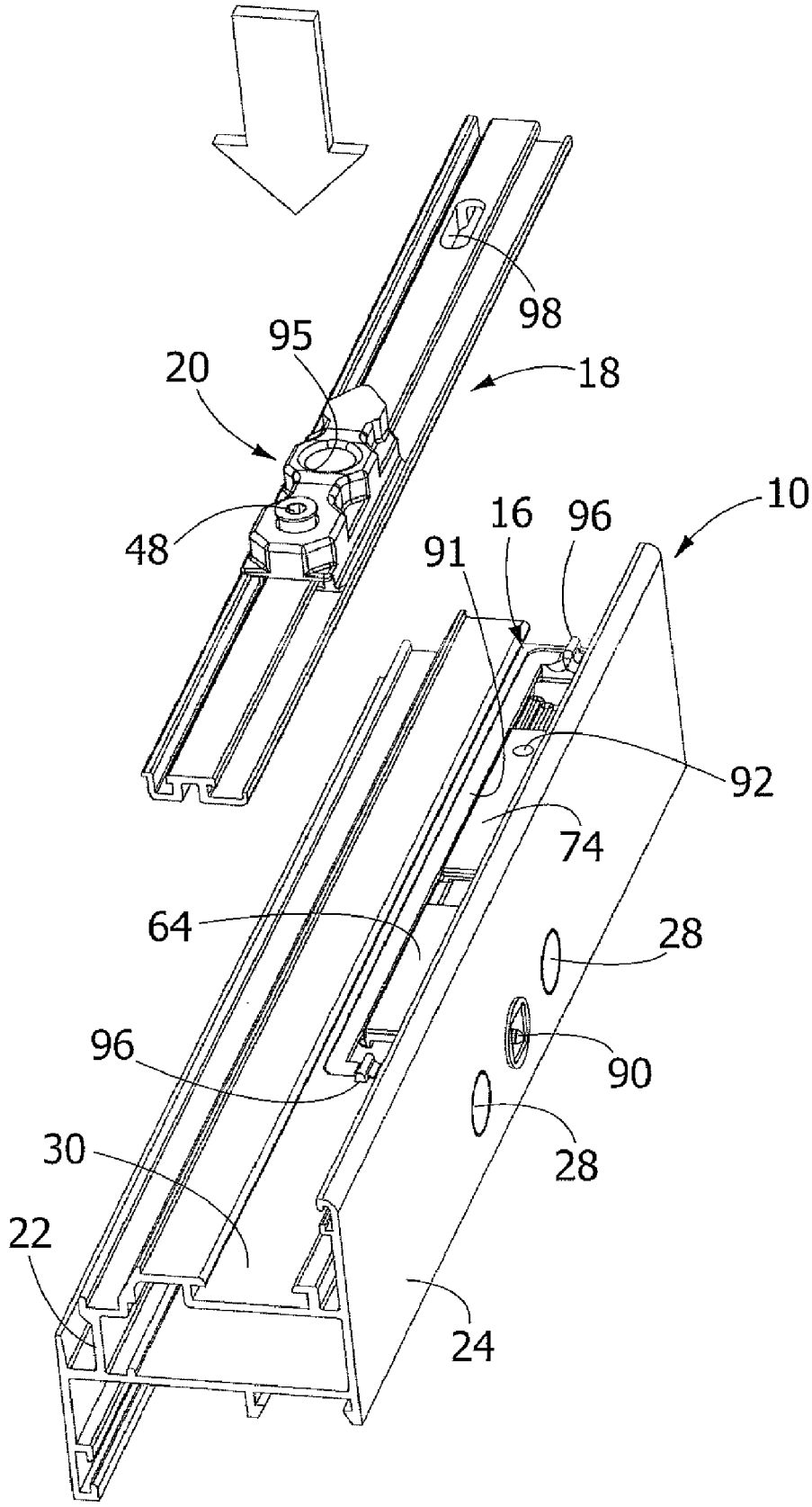

Subsequently, as shown in FIG. 14, the transmission device 16 is inserted through the opening 91 of the section bar 10. FIG. 15 shows the transmission device 16 housed within the cavity of the box portion 22. It can be noted that the transmission device 16 is almost entirely contained within the cavity of the box body 22. The only parts of the transmission device 16 that project beyond the bottom wall of the groove 30 are the appendages 96.

Also with reference to FIG. 15, the connecting member 20 is applied in slidable manner on the rod 18, similarly to the manner described with reference to the first embodiment. The screw 48 whose purpose is to fasten the connecting member 20 to the rod 18 is not fully screwed, so the connecting member 20 is free to slide on the rod in longitudinal direction.

Figure 16:
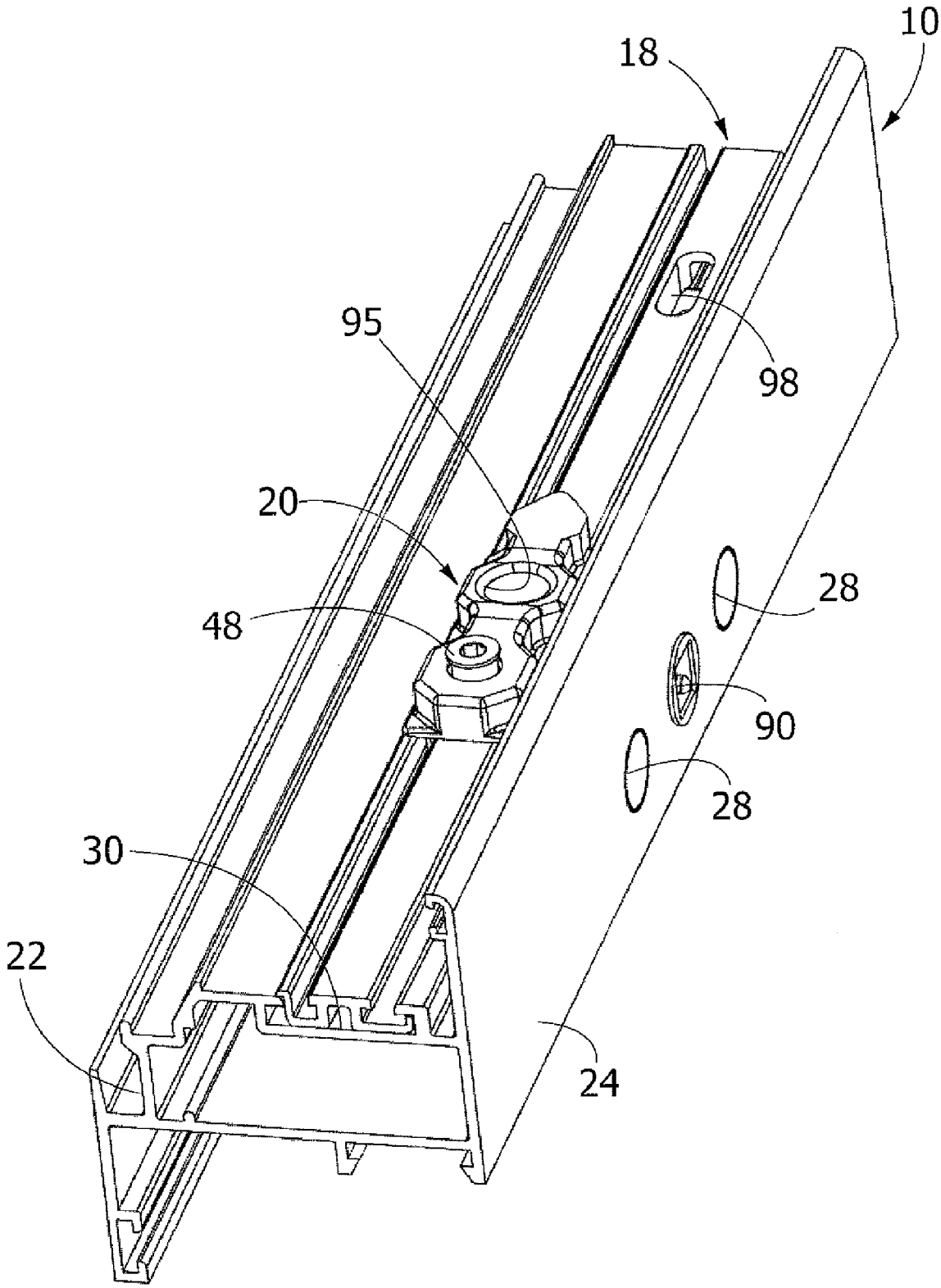

In the subsequent step, shown in FIG. 16, the rod 18 is inserted into the groove 30 of the section bar 10, above the transmission device 16. The connecting member 20 is always free to slide relative to the rod 18. When the rod 18 is mounted into the groove 30, the elongated opening 98 is situated at the hole 92 of the transmission device 16.

Figure 17:
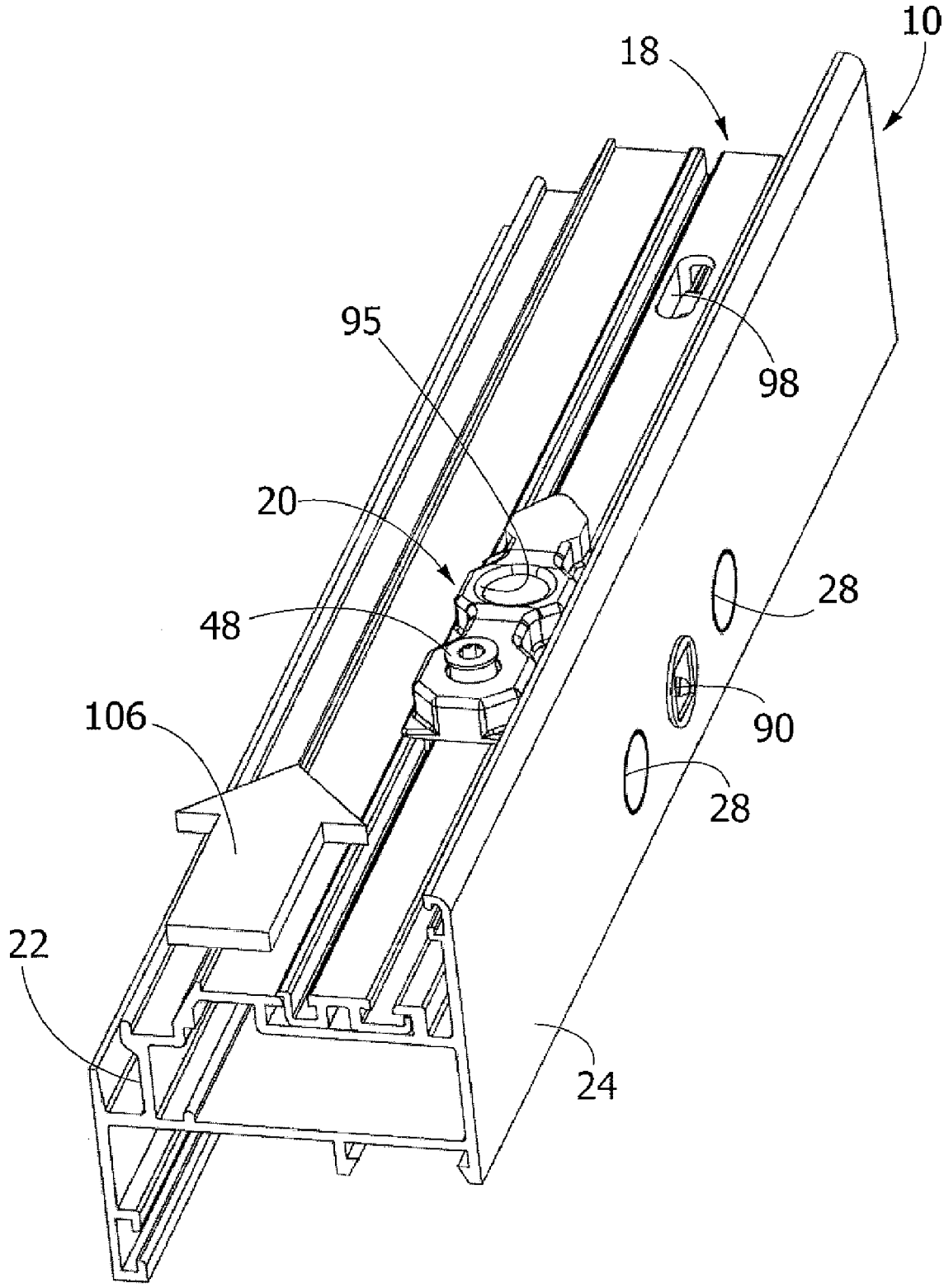
Figure 18:
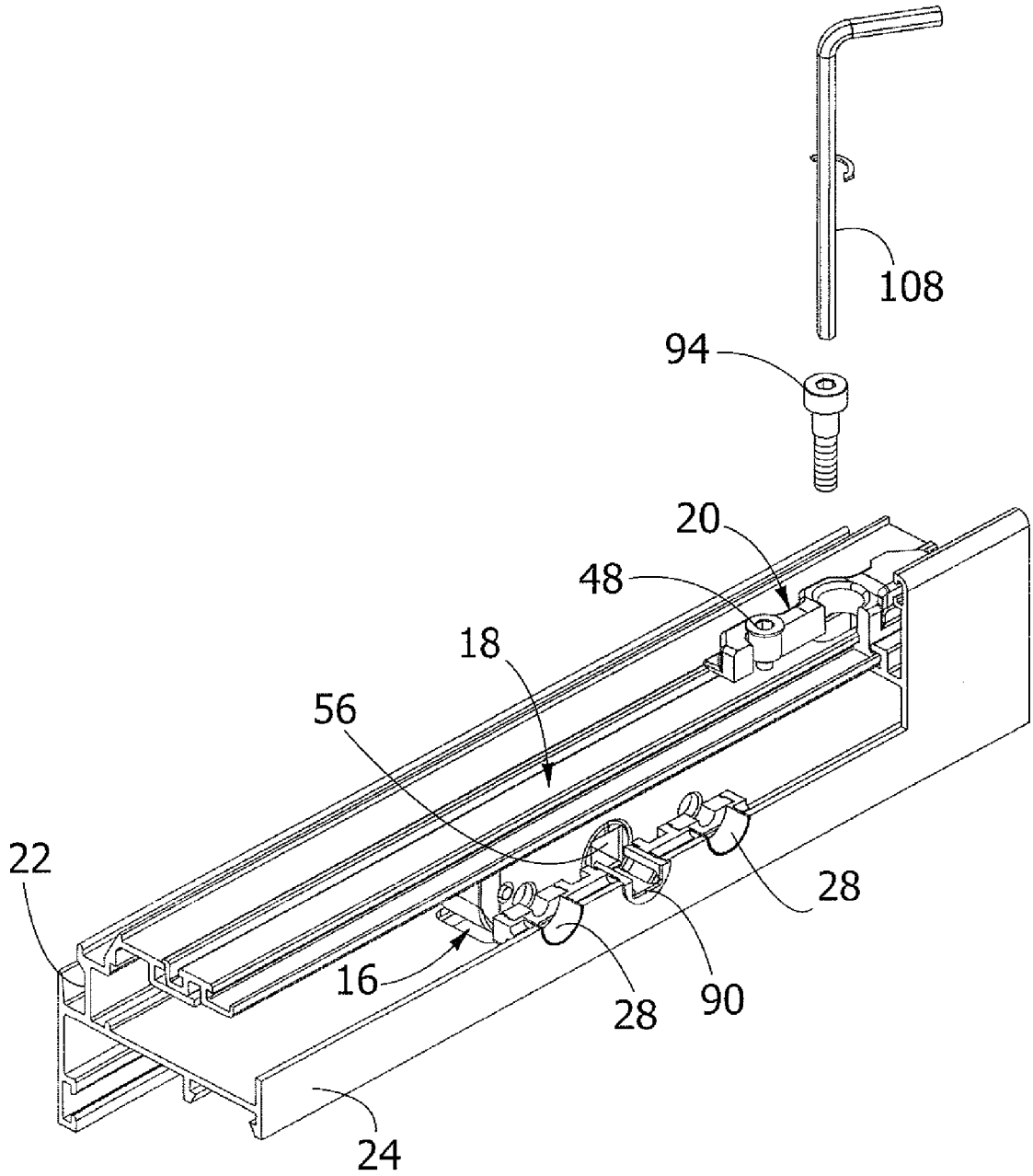
Figure 19:
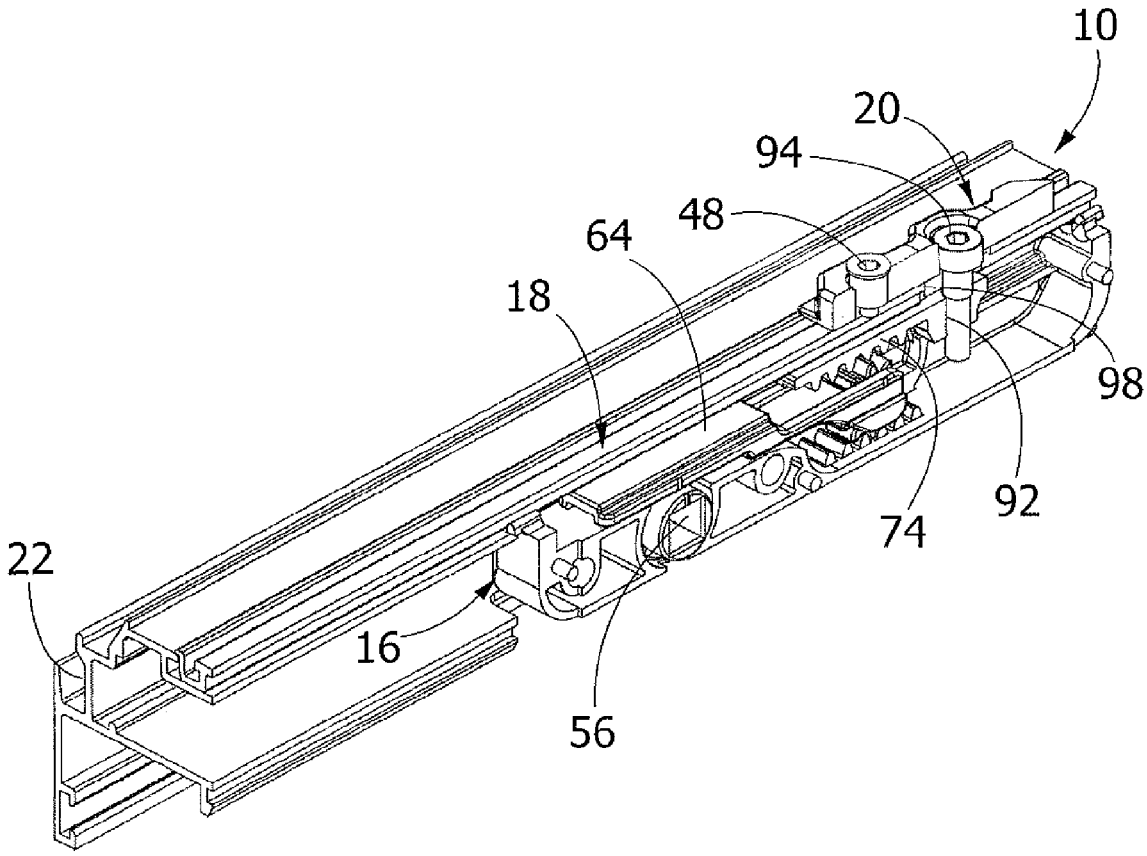

Then, as shown in FIG. 17, the connecting member 20 is made to slide on the rod 18 in the direction indicated by the arrow 106, until bringing the through hole 95 of the connecting member 20 to the elongated opening 98 and to the hole 92 provided on the carriage 74 of the transmission member 16. Then, as shown in FIGS. 18 and 19, the screw 94 is screwed by means of a spanner 108. As a result of the tightening of the screw 94, the connecting body 20 is integral with the second carriage 74 of the transmission member 16. However, the rod 18 is not yet fastened to the connecting member 20 because the screw 94 extends with play through the elongated opening 98.

Figure 20:
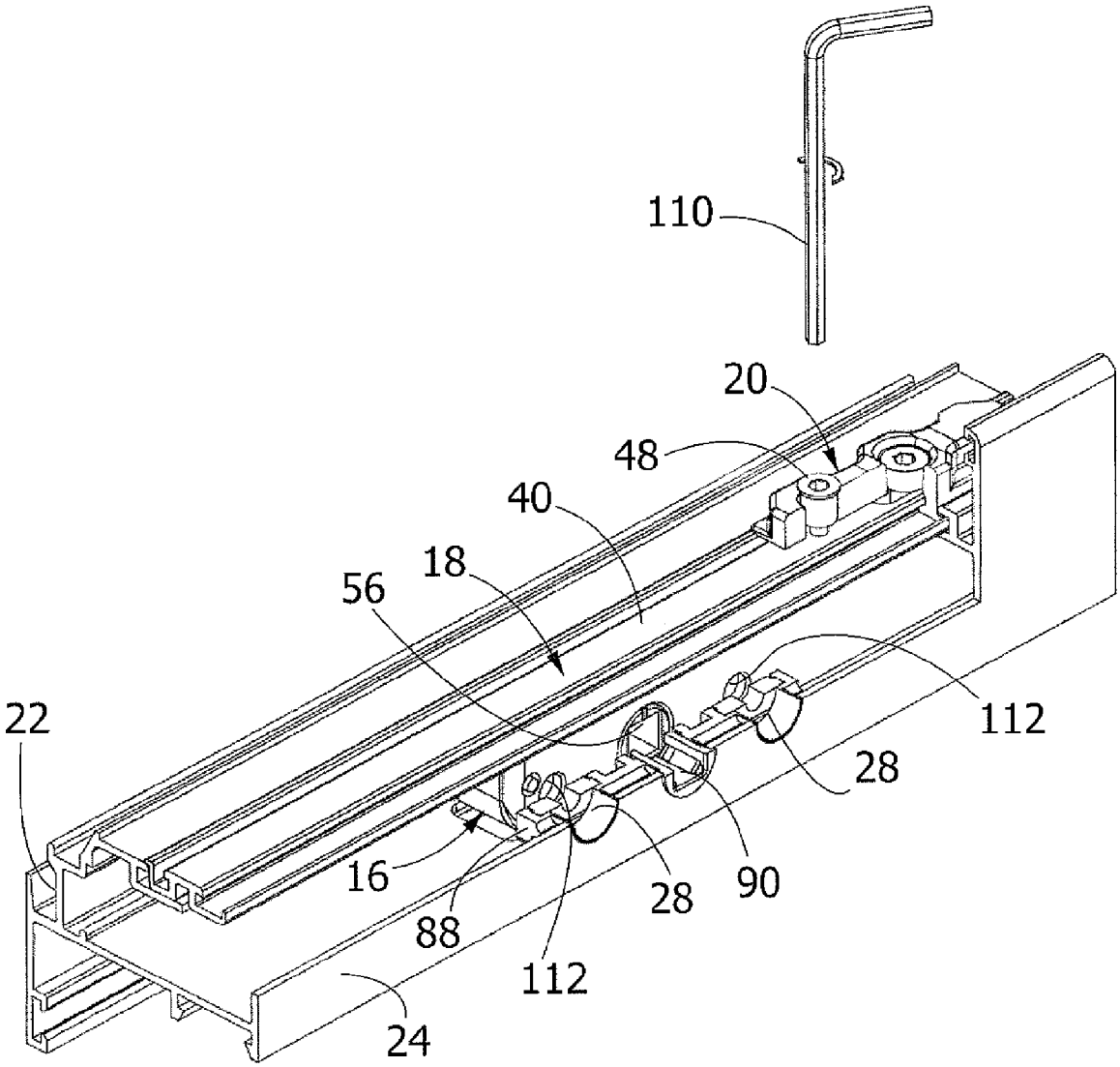

In the relative position obtained, the connecting member 20 is then fastened to the rod 18. Said fastening is carried out by completely tightening the screw 48 by means of a spanner 110, as shown in FIG. 20. When the screw 48 is tightened completely, a through hole is formed in the longitudinal wall 40 of the rod 18, similarly to what is described with reference to the previous embodiment.

Figure 21:
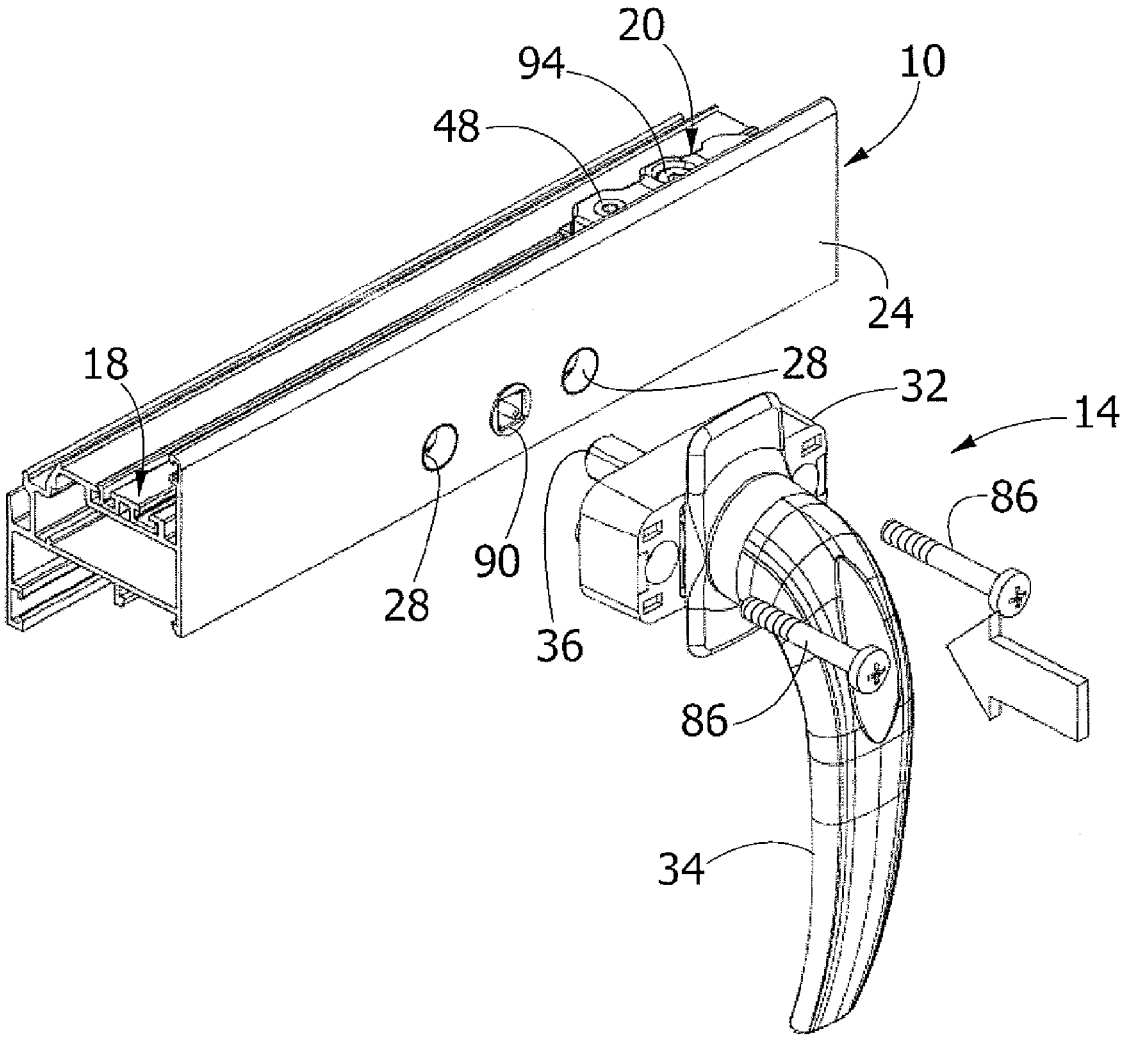

Lastly, as shown in FIG. 21, the handle 14 is mounted on the outer wall 24 of the section bar 10. The control pin 36 of the handle 14 is inserted into the bushing 90 and the square hole of the input member 56 of the transmission device 16. The fastening screws 86 of the handle 14 are inserted through the lateral holes of the outer wall 24 and of the spacer 88 (FIG. 20). The screws 86 engage respective threaded holes 112 (FIG. 20) formed in the enclosure of the transmission device 16. In this second embodiment, the mounting of the handle 14 can also be carried out after transporting the frame to the installation site. This reduces the bulk of the frames during transport to the installation site and eliminates the risk of damaging the handle during transport.

While the foregoing is directed to embodiments of the present invention, other and further embodiments of the invention may be devised without departing from the basic scope thereof, and the scope thereof is determined by the claims that follow.

The invention claimed is:

1. A method for mounting a control assembly for doors or windows, in which the door or window comprises a frame including a metallic section bar having an outer wall and a longitudinal groove with an undercut section and an open edge contained in a plane that is orthogonal to said outer face, and in which the control assembly comprises:

a handle having a base, a rotatable grip and a rotatable control pin rotatably connected to the grip, a transmission device having an input member able to be coupled with the control pin of the handle and at least one carriage movable in a rectilinear direction and connected to the input member by a mechanism able to transform the rotary motion of the input member into a rectilinear motion of said carriage, a rod able to slidably engage said groove, and a connecting member able to be fastened to the rod, the method comprising:

positioning said rod in said groove with said connecting member positioned slidably on the rod, applying the transmission device to the section bar, mutually connecting said carriage and said connecting member so that the connecting member is fixed to said carriage in a longitudinal direction of the groove, and after mutually connecting said carriage and the connecting member, fastening the connecting member to the rod.

2. The method as claimed in claim 1, wherein a screw fastens the connecting member and the rod by forming a through hole in the rod.

3. The method as claimed in claim 1, wherein there is a single rod associated with said transmission device.

4. The method as claimed in claim 1, wherein the transmission device and the handle are fastened at opposite parts of said outer wall of the section bar.

* * * * *